US006557365B2

(12) United States Patent
Dinnage et al.

(10) Patent No.: US 6,557,365 B2
(45) Date of Patent: May 6, 2003

(54) DESICCANT REFRIGERANT DEHUMIDIFIER

(75) Inventors: Paul A. Dinnage, Stratham, NH (US); Stephen C. Brickley, Newbury, MA (US)

(73) Assignee: Munters Corporation, Amesbury, MA (US)

( * ) Notice: Subject to any disclaimer, the term of this patent is extended or adjusted under 35 U.S.C. 154(b) by 0 days.

(21) Appl. No.: 09/795,818

(22) Filed: Feb. 28, 2001

(65) Prior Publication Data

US 2002/0116934 A1 Aug. 29, 2002

(51) Int. Cl.[7] ..... F25D 23/00; F25D 17/06
(52) U.S. Cl. ..... 62/271; 62/94
(58) Field of Search ..... 62/271, 94, 93

(56) References Cited

U.S. PATENT DOCUMENTS

| | | | | | |
|---|---|---|---|---|---|
| 2,186,844 | A | * | 1/1940 | Smith | 62/94 |
| 2,562,811 | A | | 7/1951 | Muffly | 62/103 |
| 2,946,201 | A | | 7/1960 | Munters | 62/94 |
| 2,968,165 | A | * | 1/1961 | Norback | 62/271 |
| 3,247,679 | A | | 4/1966 | Meckler | 62/271 |
| 3,401,530 | A | | 9/1968 | Meckler | 62/2 |
| 4,113,004 | A | | 9/1978 | Rush et al. | 165/3 |
| 4,180,985 | A | | 1/1980 | Northrup, Jr. | 62/94 |
| 4,474,021 | A | * | 10/1984 | Harband | 62/94 |
| 5,170,633 | A | | 12/1992 | Kaplan | 62/94 |
| 5,353,606 | A | | 10/1994 | Yoho et al. | 62/271 |
| 5,373,704 | A | | 12/1994 | McFadden | 62/94 |
| 5,502,975 | A | | 4/1996 | Brickley et al. | 62/94 |
| 5,517,828 | A | | 5/1996 | Calton et al. | 62/271 |
| 5,526,651 | A | | 6/1996 | Worek et al. | 62/271 |
| 5,551,245 | A | | 9/1996 | Calton et al. | 62/90 |
| 5,564,281 | A | | 10/1996 | Calton et al. | 62/90 |
| 5,579,647 | A | | 12/1996 | Calton et al. | 62/94 |
| 5,632,954 | A | | 5/1997 | Coellner et al. | 422/4 |
| 5,649,428 | A | | 7/1997 | Calton et al. | 62/94 |
| 5,660,048 | A | | 8/1997 | Belding et al. | 62/94 |
| 5,701,762 | A | | 12/1997 | Akamatsu et al. | 62/636 |
| 5,727,394 | A | | 3/1998 | Belding et al. | 62/94 |
| 5,758,508 | A | | 6/1998 | Belding et al. | 62/94 |
| 5,761,915 | A | | 6/1998 | Rao | 62/94 |
| 5,761,923 | A | | 6/1998 | Maeda | 62/271 |
| 5,791,153 | A | | 8/1998 | Belding et al. | 62/93 |
| 5,816,065 | A | | 10/1998 | Maeda | 62/271 |
| 5,825,641 | A | | 10/1998 | Bierwirth et al. | 165/48.1 |
| 5,890,372 | A | | 4/1999 | Belding et al. | 62/271 |
| 5,931,016 | A | * | 8/1999 | Yoho | 62/271 |
| 5,943,874 | A | | 8/1999 | Maeda | 62/271 |
| 6,003,327 | A | | 12/1999 | Belding et al. | 62/271 |
| 6,018,953 | A | | 2/2000 | Belding et al. | 62/94 |
| 6,029,462 | A | | 2/2000 | Denniston | 62/94 |
| 6,029,467 | A | * | 2/2000 | Moratalla | 62/271 |
| 6,050,100 | A | | 4/2000 | Belding et al. | 62/271 |
| 6,094,835 | A | | 8/2000 | Cromer | 34/80 |
| 6,141,979 | A | | 11/2000 | Dunlap | 62/176.6 |

* cited by examiner

*Primary Examiner*—William C. Doerrler
(74) *Attorney, Agent, or Firm*—Fitzpatrick, Cella, Harper & Scinto

(57) ABSTRACT

A method and apparatus for conditioning air for an enclosure is disclosed in which a supply air stream, preferably from the atmosphere is cooled by the cooling coil of a refrigerant cooling system to reduce the temperature and humidity thereof to first predetermined level. The thus cooled and dehumidified air is then passed through a segment of a rotating desiccant wheel under conditions which reduce moisture content and increase temperature to a second predetermined temperature range. The supply air is then delivered from the desiccant wheel to the enclosure. The desiccant wheel is regenerated by heating a separate regeneration air stream, also preferably from the atmosphere, using the condensing coil of the refrigerant system in order to increase the regeneration air stream temperature to a third predetermined temperature range. The thus heated regeneration air stream is then passed through another segment of the rotating desiccant wheel to regenerate the wheel.

25 Claims, 10 Drawing Sheets

DESICCANT REFRIGERANT DEHUMIDIFIER

BACKGROUND OF THE INVENTION

FIELD OF THE INVENTION

The present invention relates to air conditioning and dehumidification equipment, and more particularly to an air conditioning method and apparatus using desiccant wheel technology.

It is well known that traditional air conditioning designs are not well adapted to handle both the moisture load and the temperature loads of a building space. Typically, the major source of moisture load in a building space comes from the need to supply external make-up air to the space since that air usually has a higher moisture content than required in the building. In conventional air conditioning systems, the cooling capacity of the air conditioning unit therefore is sized to accommodate the latent (humidity) and sensible (temperature) conditions at peak temperature design conditions. When adequate cooling demands exists, appropriate dehumidification capacity is achieved. However, the humidity load on an enclosed space does not vary directly with the temperature load. That is, during morning and night times, the absolute humidity outdoors is nearly the same as during higher temperature midday periods. Thus, at those times there often is no need for cooling in the space and therefore no dehumidification takes place. Accordingly, preexisting air conditioning systems are poorly designed for those conditions. Those conditions, at times, lead to uncomfortable conditions within the is building and can result in the formation of mold or the generation of other microbes within the building and its duct work, leading to what is known as Sick Building Syndrome. To overcome these problems, ASHRAE Draft Standard 62-1989 recommends the increased use of make-up air quantities and recommends limits to the relative humidity in the duct work. If that standard is properly followed, it actually leads to a need for even increased dehumidification capacity independent of cooling demands.

A number of solutions have been suggested to overcome this problem. One solution, known as an "Energy Recovery Ventilator (ERV)," is shown in FIG. 1 of the drawings and utilizes a conventional desiccant coated enthalpy wheel to transfer heat and moisture from the make-up air stream to an exhaust air stream. These devices are effective in reducing moisture load, but require the presence of an exhaust air stream nearly equal in volume to the make-up air stream in order to function efficiently. ERVs are also only capable of reducing the load since the delivered air will always be at a higher absolute humidity in the summer months than the return air. Without active dehumidification in the building, the humidity in the space will rise as the moisture entering the system exceeds the moisture leaving in the exhaust stream. However, ERVs are relatively inexpensive to install and operate.

Other prior art systems use so-called cool/reheat devices as shown schematically in FIG. 2. In these devices the outside air is first cooled to a temperature corresponding to the desired building internal dew point. The air is then reheated to the desired temperature, most often using a natural gas heater. Occasionally, heat from a refrigerant condenser system is also used to reheat the cooled and dehumidified air stream. Such cool/reheat devices are relatively expensive and inefficient, because excess cooling of the air must be done, followed by wasteful heating of air in the summer months.

A third category of prior art device has also been suggested using desiccant cooling systems, as shown for example in FIG. 3. In these devices supply air from the atmosphere is first dehumidified using a desiccant wheel or the like and the air is then cooled using a heat exchanger. The heat from this air is typically transferred to a regeneration air stream and is used to provide a portion of the desiccant regeneration power requirements. The make-up air is delivered to the space directly, as is, or alternatively is cooled either by direct evaporative means or through more traditional refrigerant-type air conditioning equipment. The desiccant wheel is regenerated with a second air stream which originates either from the enclosure being air conditioned or from the outside air. Typically, this second air stream is used to collect heat from the process air before its temperature is raised to high levels of between 150° F. to 350° F. as required to achieve the appropriate amount of dehumidification of the supply air stream. Desiccant cooling systems of this type can be designed to provide very close and independent control of humidity and temperature, but they are typically more expensive to install that traditional systems. Their advantage is that they rely on low cost sources of heat for the regeneration of the desiccant material.

U.S. Pat. No. 3,401,530 to Meckler, U.S. Pat. No. 5,551,245 to Carlton, and U.S. Pat. No. 5,761,923 to Maeda disclose other hybrid devices wherein air is first cooled via a refrigerant system and dried with a desiccant. However, in all of these disclosures high regeneration temperatures are required to adequately regenerate the desiccant. In order to achieve these high temperatures, dual refrigerant circuits are needed to increase or pump up the regeneration temperature to above 140° F. In the case of the Meckler patent, waste heat from an engine is used rather than condenser heat. U.S. Pat. No. 4,180,985 to Northrup discloses a device wherein refrigerant condensing heat is used to regenerate a desiccant wheel or belt. In the Northrup system, the refrigerant circuit cools the air after it has been dried. As discussed below, this cycle is not as effective or efficient as the cycle proposed in accordance with the present invention.

It is an object of the present invention to treat outside supply air and condition it to so-called space neutral conditions in an efficient and economic manner.

Yet another object of-the present invention is to provide a desiccant based dehumidification and air conditioning system which is relatively inexpensive to manufacture and to operate.

A further object of the present invention is to provide an air conditioning system which enables the operator to vary the latent/sensible cooling ratios provided by the system.

The present invention is particularly suited to take outside air of humid conditions, such as are typical in the South and Southeastern portions of the United States and in Asian countries and render it to a space neutral condition. This condition is defined as ASHRAE comfort zone conditions and typically consists of conditions in the range of 73–78° F. and a moisture content of between 55–71 gr/lb or about 50% relative humidity. In particular, the system is capable of taking air of between 85–95° F. and 130–145 gr/lb of moisture and reducing it to the ASHRAE comfort zone conditions. However, as will be understood by those skilled in the art, the system or process of the present invention will also work above and below these conditions, e.g., at temperatures of 65–85° F. or 95° F. and above and moisture contents of 90–130 gr/lb or 145–180 gr/lb.

As compared to conventional techniques as discussed above, the present invention has significant advantages over alternative techniques for producing air at indoor air comfort zone conditions from outside air. The most significant advantage of the invention is low energy consumption. That is, the energy required to treat the air with a desiccant assist in accordance with the present invention is 25–45% less than that used in previously disclosed cooling technologies.

In accordance with an aspect of the present invention, a method and apparatus is disclosed in which a conventional refrigerant cooling system is combined with a rotatable desiccant wheel. The refrigerant cooling system includes a conventional cooling coil, condensing coil and compressor. Means are provided for drawing a supply air stream, preferably an outdoor air stream over the cooling coil of the refrigerant system to reduce its humidity and temperature to a first predetermined temperature range. The thus cooled supply air stream is then passed through a segment of the rotary desiccant wheel to reduce its moisture content to a predetermined humidity level and increase its temperature to a second predetermined temperature range. Both the temperature and humidity ranges are within the comfort zone. This air is then delivered to the enclosure.

The system of the present invention also includes means for regenerating the desiccant wheel by passing a regeneration air stream, typically also from an outside air supply, over the condensing coil of the refrigerant system, thereby to increase its temperature to a third predetermined temperature range. The thus heated regeneration air is passed through another segment of the rotatable desiccant wheel to regenerate the wheel.

The above, and other objects, features and advantages of the present invention will be apparent in the following detailed description of illustrative embodiments thereof, which is to be read in connection with accompanying drawings, wherein.

Figure 5:
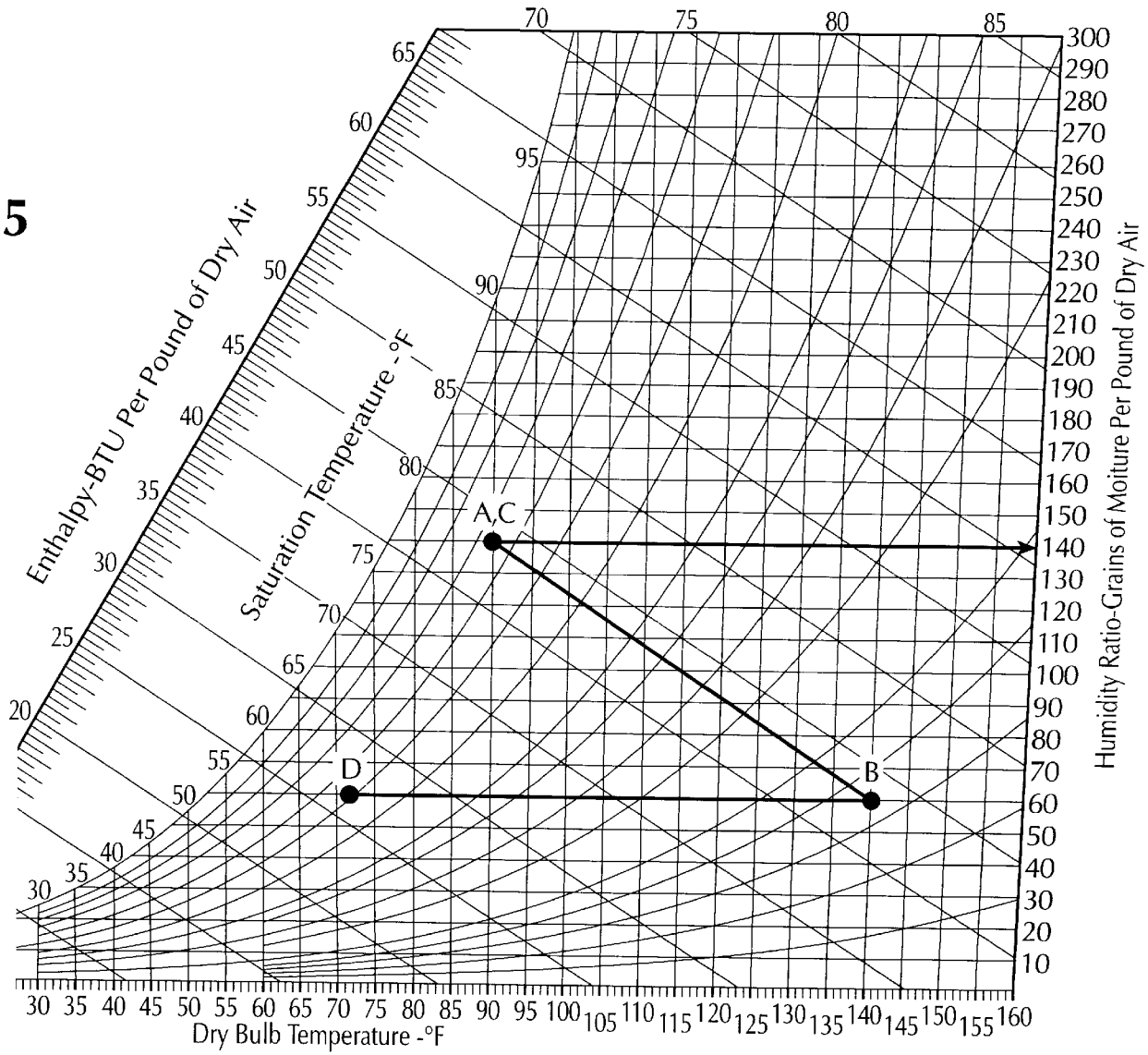
Figure 6:
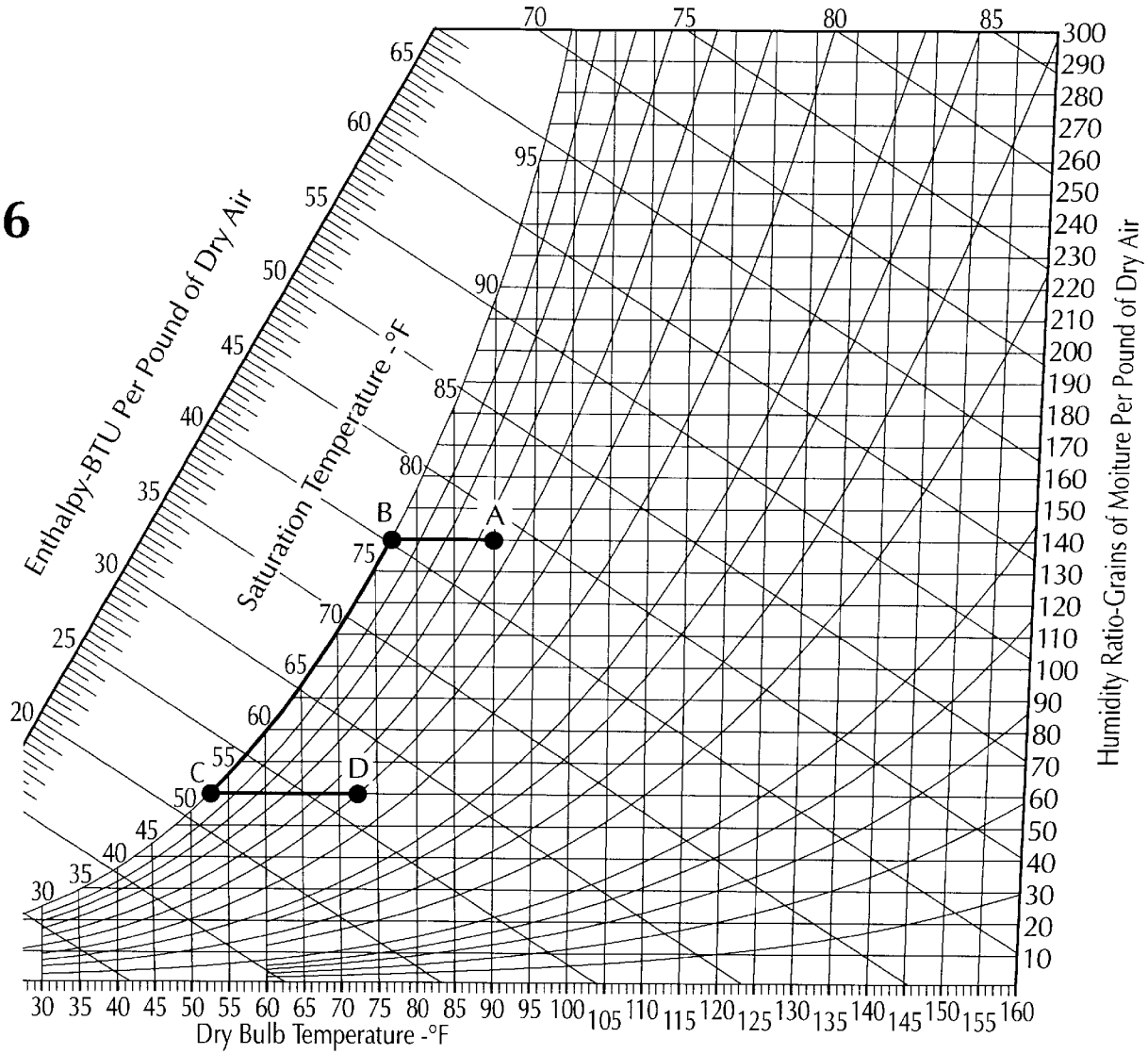
Figure 7:
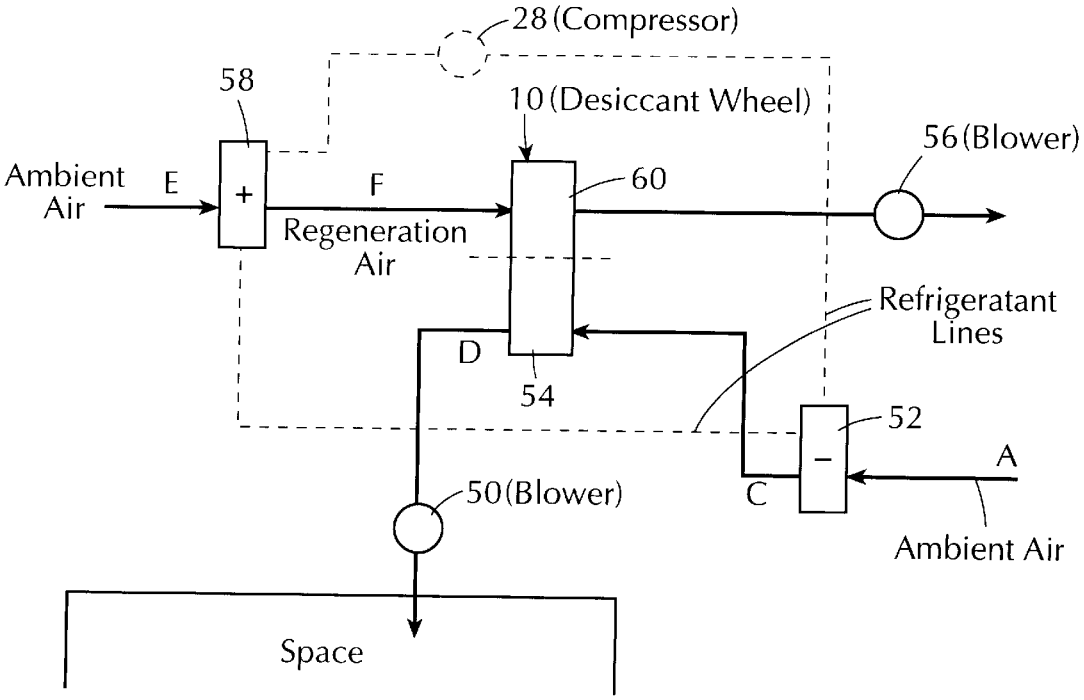
Figure 8:
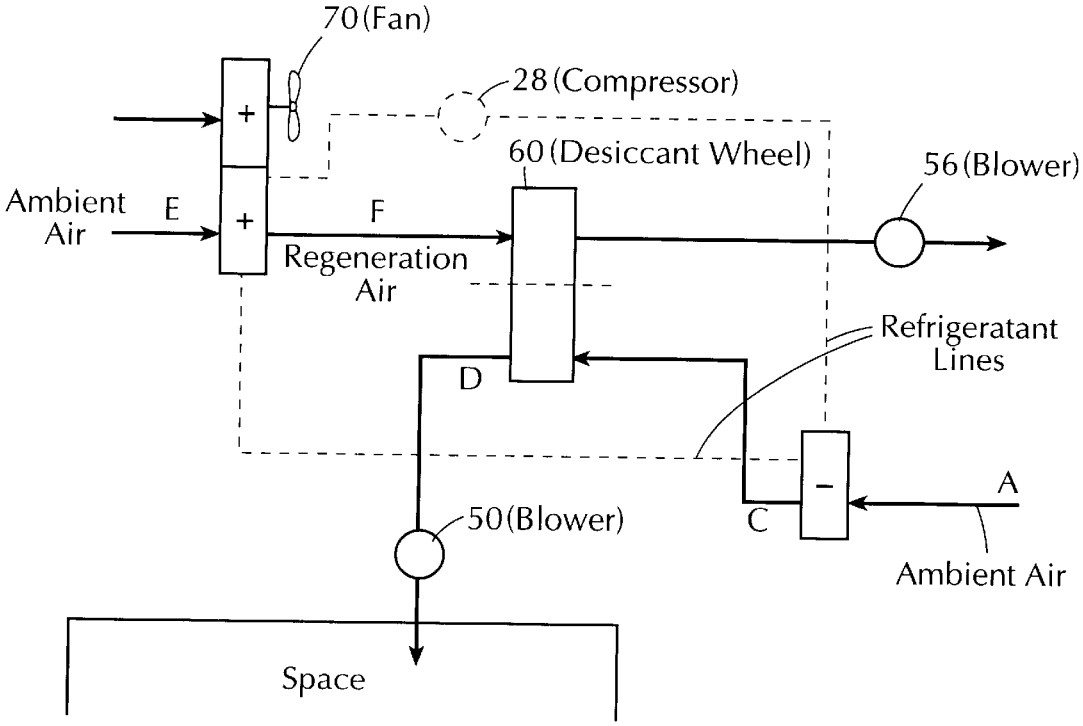
Figure 9:
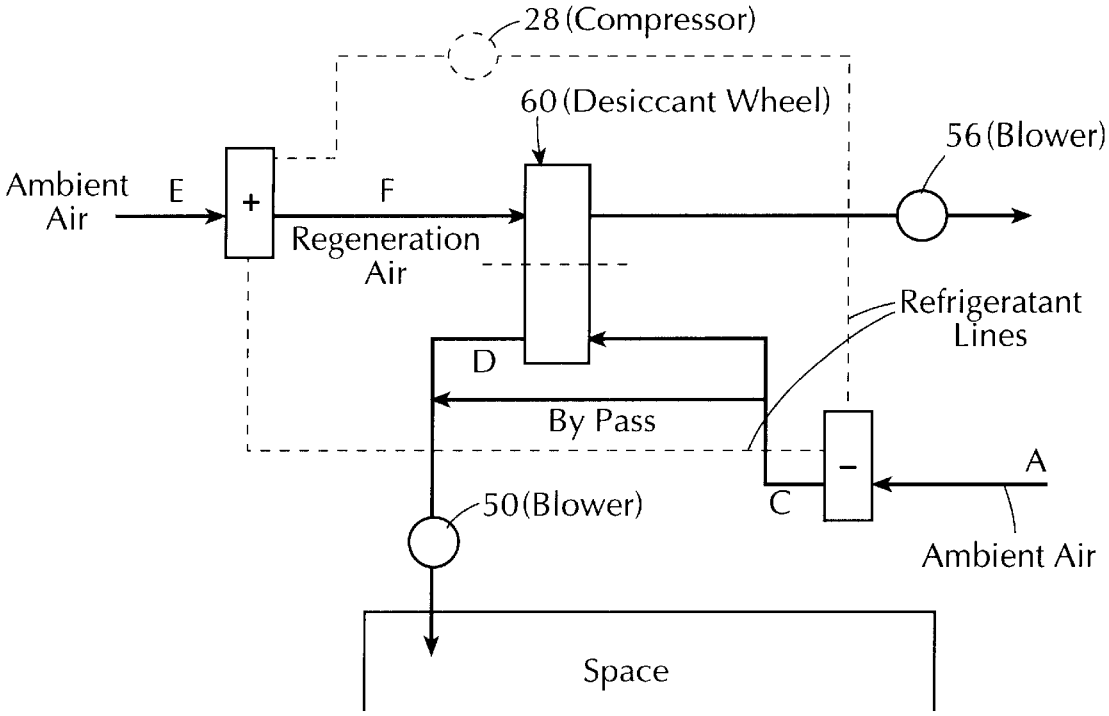
Figure 10:
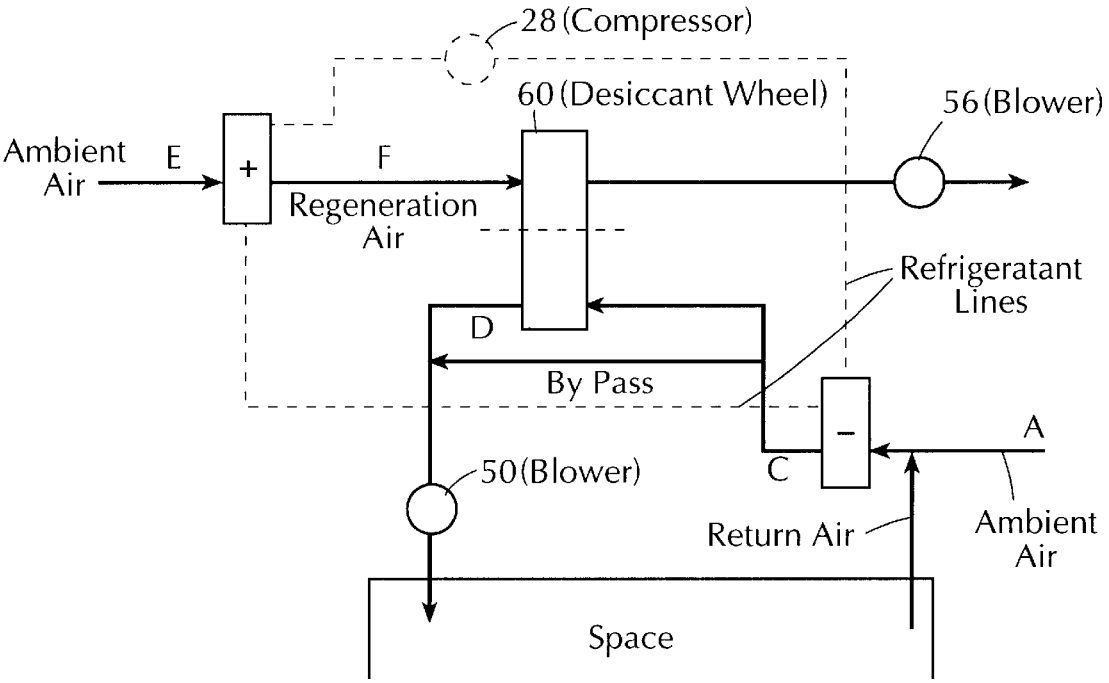
Figure 11:
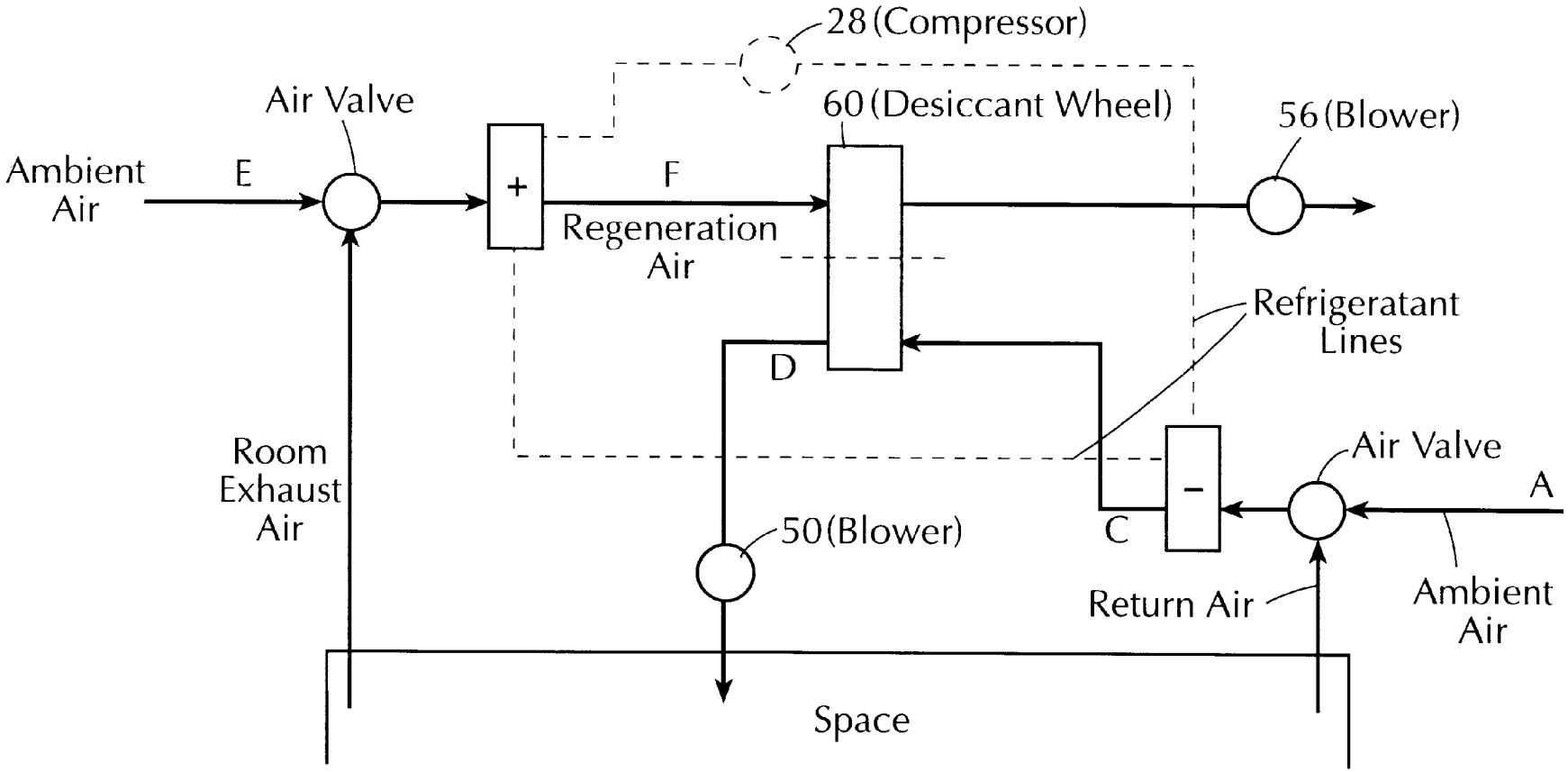
Figure 12:
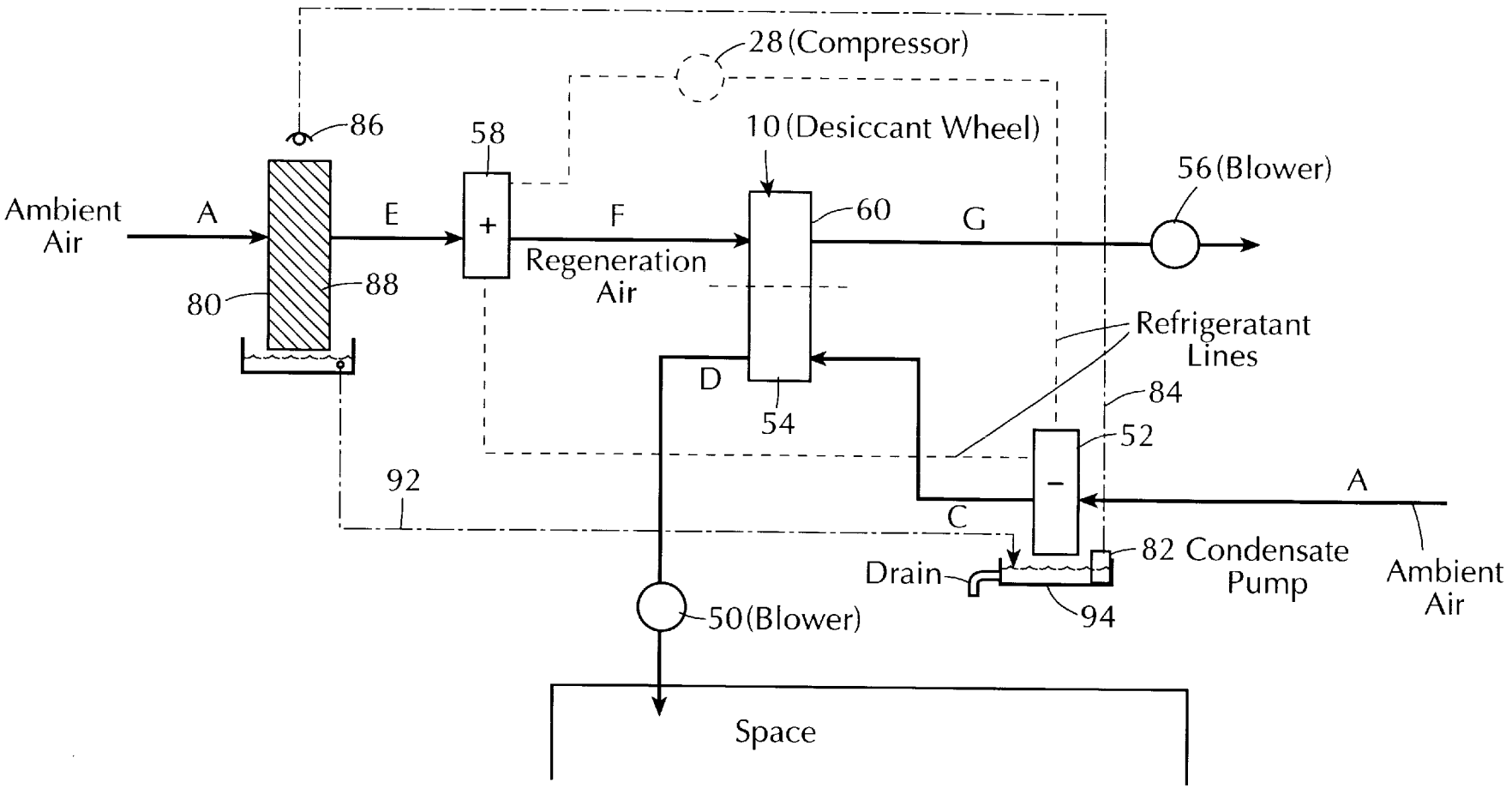
Figure 13:
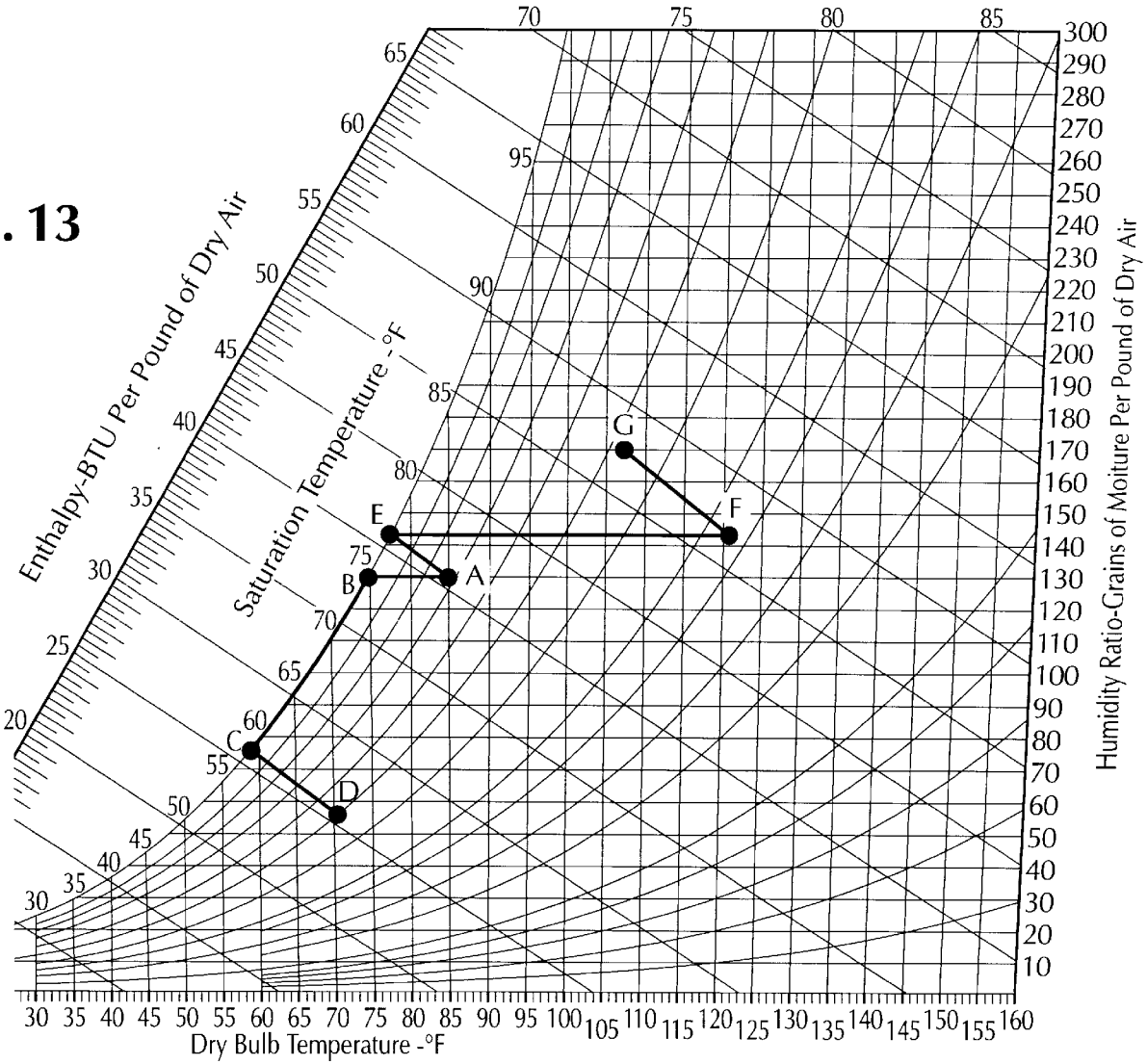

FIG. 5 is a psychometric chart showing the cycle achieved with a prior art system such as shown in Northrup U.S. Pat. No. 4,180,985;

FIG. 6 is a psychometric chart for a cool/reheat system;

FIG. 7 is a schematic diagram of the basic system of the present invention;

FIG. 8 is a schematic diagram of another embodiment of the present invention in which some of the regeneration air is dissipated before entering the desiccant wheel;

FIG. 9 is a schematic diagram of another embodiment of the present invention using an air bypass for some of the supply air;

FIG. 10 is a schematic diagram of an embodiment similar to that of FIG. 9, but utilizing some of the enclosure return air for the supply air stream;

FIG. 11 is a schematic diagram of yet another embodiment of the present invention in which the system can be operated, alternatively, as an ERV system under certain conditions;

FIG. 12 is a schematic diagram similar to FIG. 7 showing another embodiment of the invention using an evaporative cooler; and FIG. 13 is a psychometric chart for the system of FIG. 12.

Figure 1:
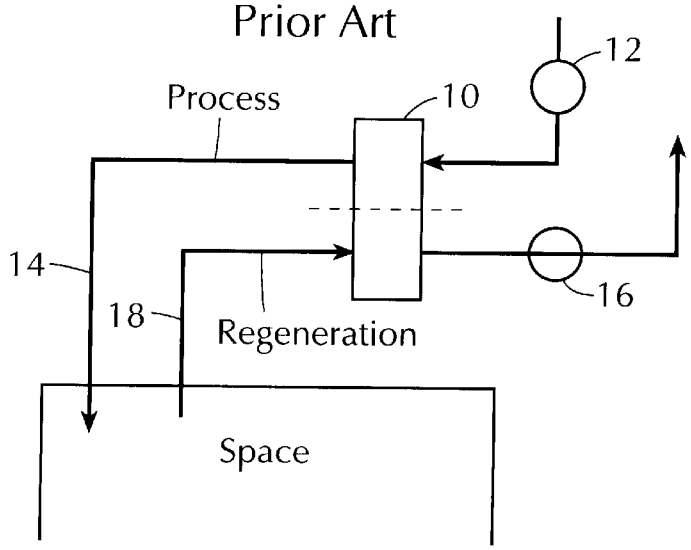
FIG. 1 Prior Art
FIG. 1 is a schematic diagram of a conventional energy recovery ventilator (ERV) system.

Referring now to the drawings in detail, and initially to FIG. 1 thereof, a prior art energy recovery ventilator air conditioning system is illustrated in which a conventional rotary passive desiccant wheel 10 is provided, operating in the conventional manner. An outside air supply is supplied to a portion or segment of the rotating desiccant wheel 10 by a fan or blower 12 and it is dehumidified. The dry air is then supplied through a duct system 14 directly to the enclosure or space to be conditioned. Return air is drawn by another fan or blower 16 through duct work 18 to and through another segment of the rotating desiccant wheel 10 in order to regenerate the desiccant in the wheel. That air is then exhausted to the atmosphere. As noted above, this type of prior art device is effective at reducing moisture load, but requires an exhaust air stream nearly equal in volume to the air supply stream.

Figure 2:
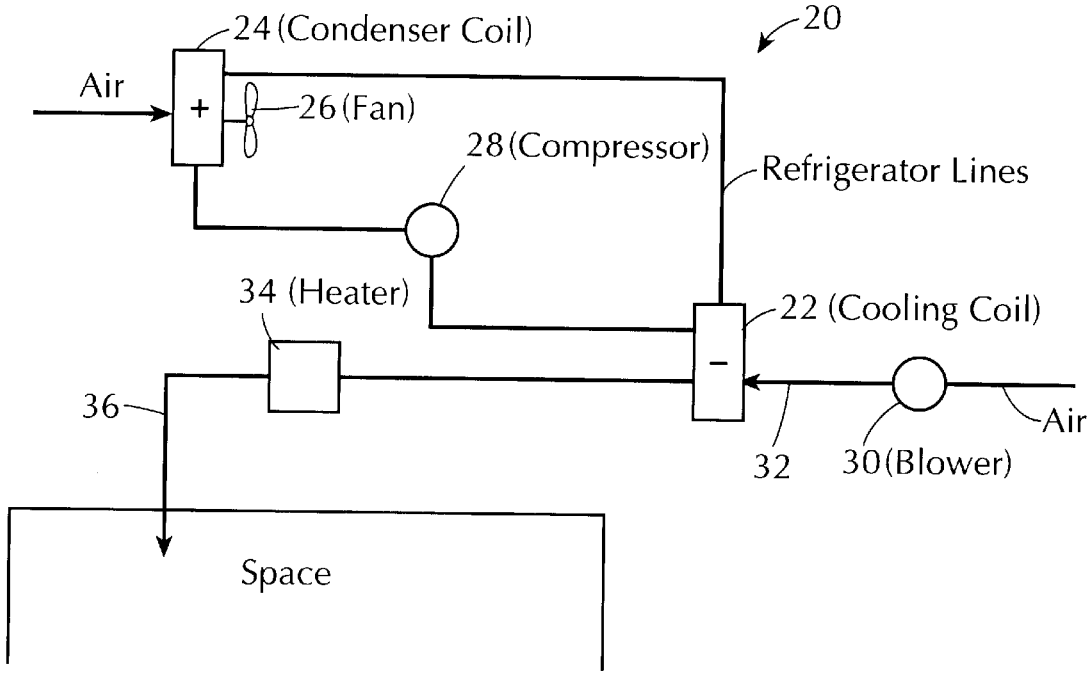
FIG. 2 Prior Art
FIG. 2 is a schematic diagram of a conventional cool/reheat air conditioning system.

FIG. 2 illustrates a cool-reheat prior art device in which a conventional refrigerant air conditioning system 20 is utilized. These systems, which are well known in the art, include a cooling coil 22, a condensing coil 24, a fan 26 and a compressor 28. In this system outside air is drawn by fan 26 over the condenser coil 24 to cool the refrigerant returning from cooling coil 22 to condenser coil 24. That refrigerant is then supplied to the cooling coil 22. A supply air stream is drawn by a fan or blower 30 from the atmosphere through a duct system 32 and passed over the cooling coil 22 to reduce the air supply stream temperature and moisture content. A heater, for example a natural gas heater, 34 is then used to increase the temperature of the cooled supply air to the desired temperature for the enclosure. The supply air system is then supplied through duct 36 to the enclosure. These systems are relatively expensive and inefficient.

Figure 3:
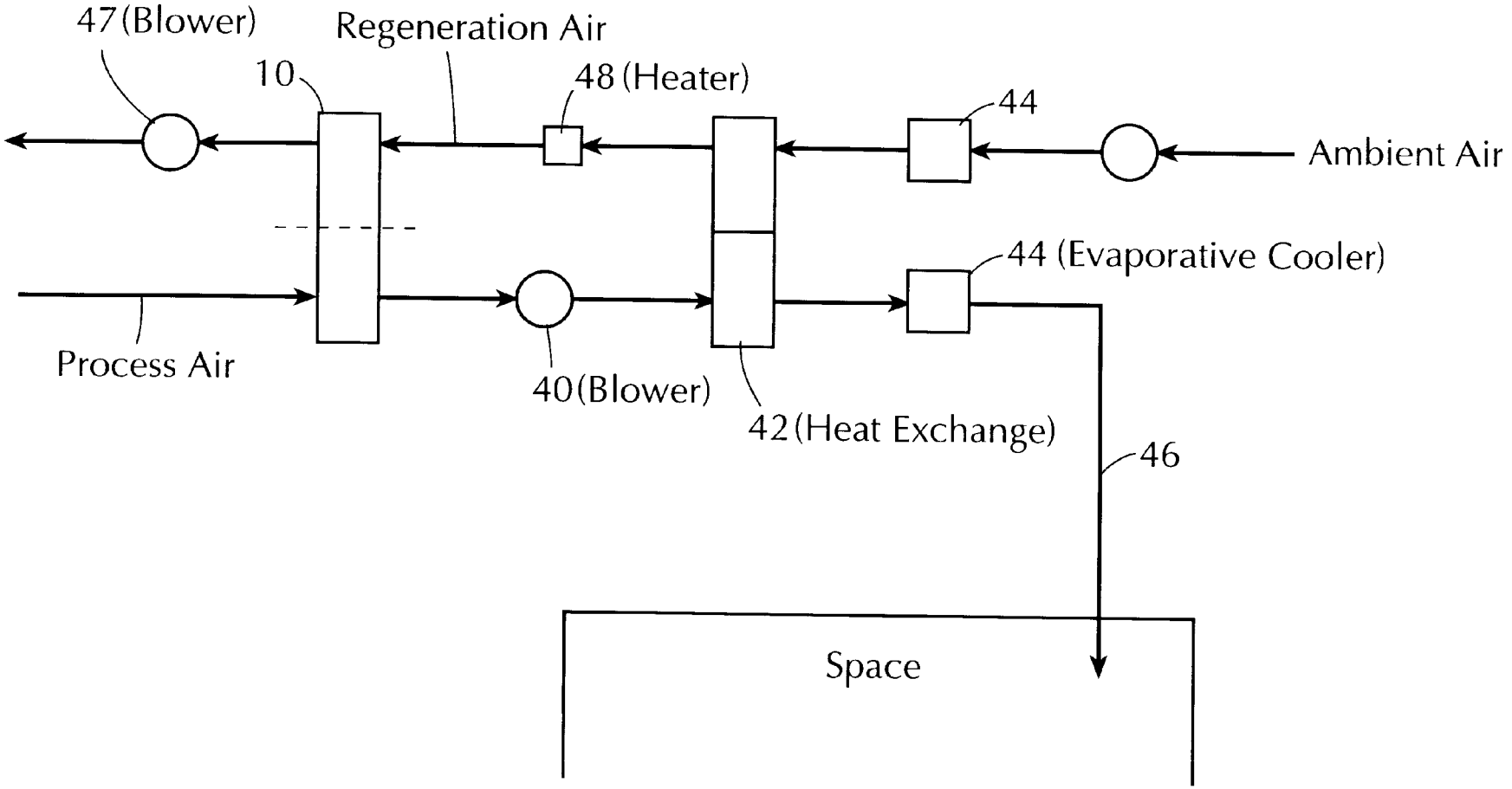
FIG. 3 Prior Art
FIG. 3 is a schematic diagram of a conventional desiccant cooling system.

FIG. 3 illustrates a known form of desiccant cooling system. In these prior art systems, an air stream from the atmosphere outside (or return air from the interior space) is drawn by a blower 40 or the like through a duct system to the rotating desiccant wheel 10. The wheel dries the outside air which is then passed to a heat exchanger where its temperature is increased. Finally, the air passes through an evaporative cooler 44 which functions to reduce the dried air's temperature further to the desired internal space temperature. From there the air and is supplied through the duct work 46 to the space or enclosure.

In the system such as shown in FIG. 3, the desiccant wheel 10 is regenerated by air from the atmosphere (or by return air from the space or enclosure) which is drawn by blower 46 through the other side of the evaporative cooler 44 and heat exchanger 42 in order to collect heat given up in them by the air supply stream (i.e., the process air) and cause the regeneration air stream's temperature to rise. If necessary, the temperature is further increased by a natural gas heater 48 or the like before it enters the regeneration sector of the desiccant wheel 10 to regenerate the desiccant. This air is then exhausted to the atmosphere.

In accordance with the present invention, as illustrated in FIG. 7, a simplified air conditioning system utilizing a conventional refrigerant cooling system and a desiccant wheel is provided. In this system, supply air from the atmosphere is drawn by a blower 50 over the cooling coil 52 of a refrigerant system where its temperature is lowered and it is slightly dehumidified. From there, the air passes through a sector 54 of the rotating desiccant wheel 10 where its temperature is increased and it is further dehumidified. That air is then provided to the enclosure or space.

Desiccant wheel 10 is regenerated by utilizing outside air drawn by a blower 56 over the condenser coil 58 of the air conditioning system. This outside air stream is heated as it passes over the condenser coil and is then supplied to another sector 60 of the rotating desiccant wheel to regenerate the desiccant. It is then exhausted to the atmosphere by the blower 56.

Figure 4:
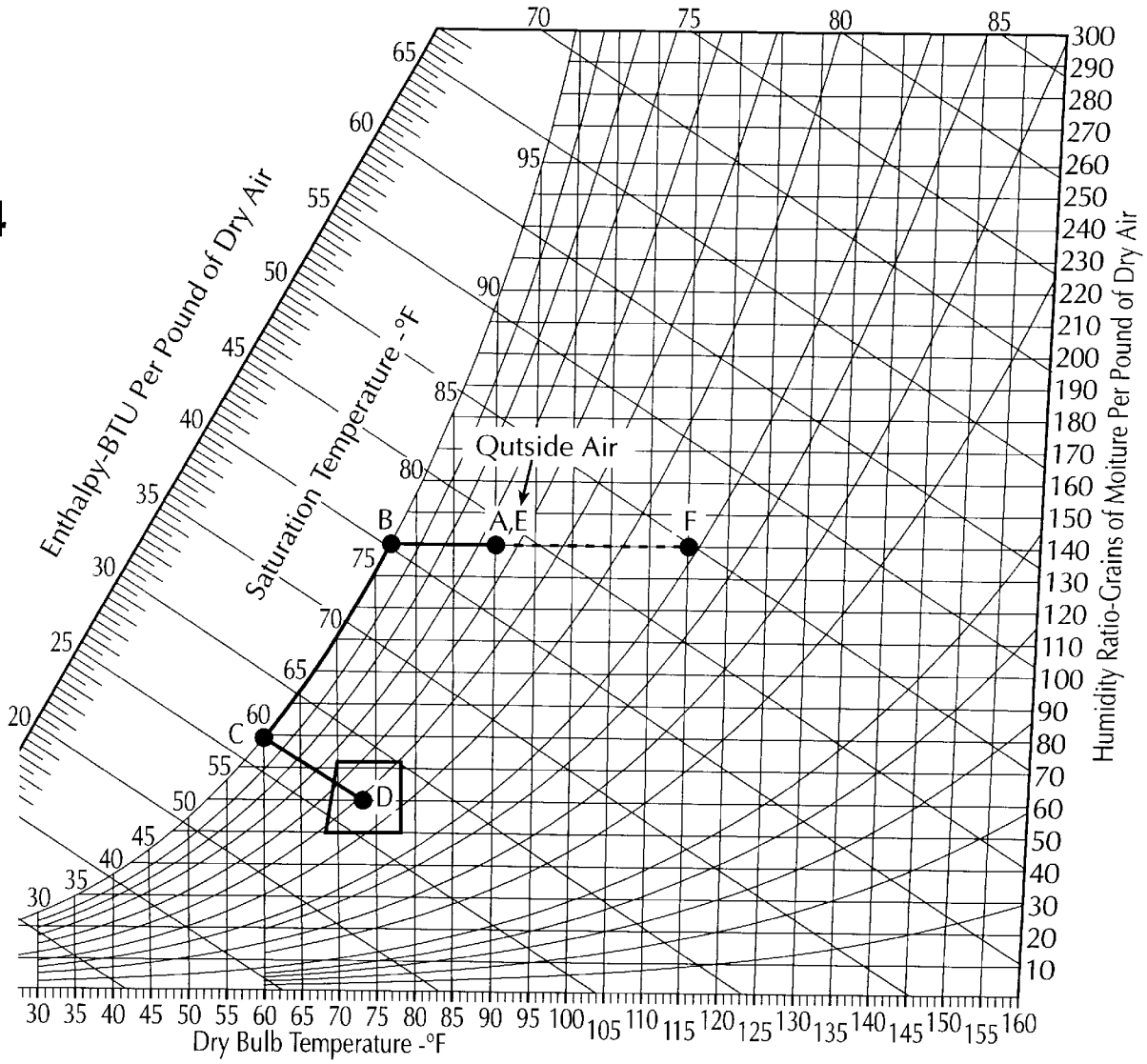
FIG. 4 is a psychometric chart describing the cycle achieved by the present invention.

The advantages of the present invention are illustrated by the psychometric charts of FIGS. 4–6. FIG. 4 illustrates the charts for the system of FIG. 7. As seen therein, the outside air entering system at point A, which in the illustrated chart has a temperature of 90° and a humidity ratio of about 140 gr/lb, initially is cooled from the atmospheric temperature condition as it passes over cooling coil 52 to its saturation line at point B and then further cooled to about 60°. As a result, the supply air stream's moisture content also is reduced to point C as it leaves the coil. This cooled and saturated air is then passed through desiccant wheel 10 where its humidity is reduced further to about 60 gr/lb, while its temperature is increased to about 74° (point D). The path the air takes on the psychometric chart will nearly follow a line of constant enthalpy from point C to point D with a small amount of temperature rise due to the heat carry-over of the wheel from the regeneration sector. The distance that the air will travel along the line of constant enthalpy is determined by the condition of the regeneration air stream. As it is desired to achieve a leaving condition from the desiccant wheel of approximately 50% relative humidity (rh), only an approximate 17 gr/lb moisture depression is required of the desiccant wheel to achieve point D from point C. This depression is very small and does not require a large amount of desiccant material nor a high regeneration temperature to regenerate the wheel.

In order to achieve this moisture depression, the regeneration air must be of the appropriate temperature and humidity. Typically, when a desiccant wheel operates with two air streams that are not far apart on the psychometric chart, the wheel will act as a relative humidity (rh) exchanger. The process air, as described above, will move down a line of constant enthalpy, i.e., from point C to point D, while the regeneration air will move up a line of constant enthalpy. In a perfectly efficient system the rh of the process air leaving the wheel will be nearly equal to the rh of the regeneration air entering the wheel. The same will be true for the regeneration air whose rh will approach, but not exceed the rh of the process air.

Accordingly, the theoretical minimum temperature required for regeneration can easily be calculated. In a perfectly efficient system, outside air (point E on the chart and in FIG. 7) need only be heated to a temperature necessary to achieve a 50%rh condition. At a typical 140 gr/lb design condition this relates only to a regeneration temperature of about 100° F. However, no mechanical systems are 100% efficient. Thus, a 10–20%rh approach between the leaving and entering air streams on one side of the wheel is typical of the desiccant wheel cycle when operating in this range. Given the same outside humidity conditions (using the same source of regeneration air and supply air), this translates into a maximum required regeneration temperature of 115° F., i.e., point F on the chart. That temperature is well below any stated temperature used for regeneration of desiccant material that is doing useful work, and is easily achieved by passing the regeneration air over the condenser coils of the refrigerant system. Thus, by passing the regeneration air over the condensing coils, that air is used to regenerate the desiccant and achieve the desired performance of the refrigerant cooling system on the delivered supply air quality, without the addition of external heat.

With the understanding that the desiccant wheel as used in the present invention acts as a relative humidity exchanger, the large efficiency differences between this invention and, for example, the system shown in the Northrup patent discussed above, are clearly demonstrated by reference to FIG. 5. In the Northrup type system as shown in FIG. 5, ambient air entering the system at point A is first passed through the desiccant rotor which results in its temperature increasing and its rh decreasing to point B. Where ambient air at outdoor conditions is to be dried from 140 br/lb to 60 gr/lb, as illustrated in the chart, the temperature rise occurring while the air moves down the line of constant enthalpy will be a minimum 50° F. Given this minimum outlet temperature of 140° F. in the illustration, the rh of this air will be less than 8%rh. In order to achieve this result with even a perfect humidity exchange device, a reactivation rh of less than 8%rh will be required. Even utilizing an ideal exchanger, this translates to a minimum regeneration temperature of 180° F. (point D) as compared to 115° F. in the present invention. This large minimum regeneration temperature is well beyond the capabilities of typical refrigerant condensing systems. Factoring real work inefficiencies, the required regeneration temperature will be in excess of 200° F., clearly indicating that the cycle cannot have the same capacity or efficiency as the present invention.

Another feature of the present invention is that the precooling and desiccant moisture reducing capacities of the system are balanced in order to exclude the need for additional cooling after the desiccant device. In all of the prior art discussed above, higher regeneration temperatures are utilized to achieve the desired desiccant humidity depression. Due to these temperatures, the temperature of the air leaving the desiccant wheel is higher than can be tolerated to be delivered to the space. Thus, in all these prior art systems, some form of post-cooling, as illustrated in FIG. 3, is usually provided and accomplished via an air-to-air heat exchanger in order to reduce the supply air temperature from point B in FIG. 5 to an acceptable limit at point N.

In comparing the current invention to conventional cool/reheat devices such as shown in FIG. 2 with reference to the psychometric chart for that device (i.e., FIG. 6), the efficiency of the present invention as compared thereto can also be clearly seen. In such a system, in order to achieve a similar delivered air quality to that provided by the present invention (i.e., the conditions at point D on the chart), the supply air (condition A) must be first cooled to between 53–58° F. (compared to the 60–65° F. of the present invention). This amounts to a more than 20% increase in the cooling needed to achieve the necessary humidity condition. That results in a decrease in compressor efficiency within the refrigeration system, due to the need to operate at a lower evaporator temperature. And, once the air is thus cooled, it must be reheated (as shown in FIG. 2) from point C to point D to achieve acceptable air temperature limits. This, of course, utilizes further energy. While it may be argued that in such cool/reheat devices reheating need not be utilized if cooling in the space is required, that will not be the case at off-peak conditions, i.e., morning or evening, and it also leads to the delivery of saturated air to the duct system.

One problem which has been encountered with desiccant cooling systems that utilize lower temperature regeneration is that the desiccant wheels tend to give off strong odors under certain operating parameters. Typically this problem has been avoided by utilizing higher regeneration temperatures, or by avoiding the passage of two nearly saturated air streams through the rotor simultaneously. In accordance with the present invention, this problem is overcome by utilizing a rotor that does not have the capability to pick up odors (for example, in the form of volatile organic compounds, "VOCs") or which contains ingredients that will contain those odor molecules even under the worst operating conditions. This is accomplished, for example, by utilizing a desiccant wheel which either contains a small pore desiccant, typically a molecular sieve that is not capable of absorbing VOC molecules, or by utilizing a silica gel desiccant that has incorporated in it an appropriate amount of odor collecting particles, such as activated carbon. Such components exist in the art of desiccant wheel technology, but have not been applied in low regeneration temperature conditions such as are present in the desiccant cooling system of the present invention.

Turning again to FIG. 7 in the illustrative embodiment, the supply air stream at a temperature of about 90° F. and a humidity of 140 gr/lb is drawn through or over the cooling coil 52 where its temperature is reduced to between 45–68° F., or preferably between 60–65° F. The air then passes through the desiccant rotor sector 54 where its moisture is reduced and temperature increased to achieve a temperature and humidity level within or just below (in terms of temperature or humidity) the ASHRAE comfort zone. This air is then delivered to the space with the fan or with the fan of an accompanying air conditioning unit.

The regeneration air stream at conditions E is first heated with the condensing coil 58 of the refrigerant cooling system and then passed through the desiccant rotor. In the preferred embodiment of the invention the air is heated to a temperature of between 105–135° F. The amount of air used for regeneration ideally should be varied in a manner that its temperature upon leaving the condenser, i.e., its regeneration, is held within that desired range.

The amount of regeneration air typically required to regenerate a desiccant is 0.5 to 1.5 times the air quantity to be supplied to a building or enclosed space. Airflow above this amount will do little to improve the performance of the desiccant, but quantities of air above this amount are often needed to provide the proper condensing energy for the refrigerant system. In accordance with a second embodiment of the invention, as illustrated in FIG. 8, a secondary fan 70 may be provided to draw a quantity of air only through the condensing coil in order to provide the proper condensing energy for the system. This air is then exhausted to the atmosphere without entering the wheel. In this manner, fan pressure drop across the desiccant wheel is minimized as the need to pull this additional air through the relatively high pressure drop desiccant wheel is avoided. Preferably, fan 70 is controlled using a conventional controller system in response to the condensing head pressure of fluid in the condensing coil. When that pressure exceeds a desired limit, typically 250–350 psi, the control system turns on the fan and the additional cooling air is provided to the condensing coil, thereby reducing the compressor head pressure. With the control set in this fashion there is an independent control of the regeneration temperature via regeneration airflow control and the compressor head pressure via the condenser fan. Alternatively the fan can be controlled in response to the temperature of the refrigerant in the refrigerant system or to the temperature of the air leaving the condenser. In another embodiment, the condenser coil can be formed in two sections, with one section receiving only the portion of the airflow drawn by fan 70, and the other being exposed only to the portion of the ambient air to be supplied to the desiccant wheel by blower 56.

By this construction of the present invention, the ratio of latent (dehumidification) work to sensible (cooling) work, can be easily changed in a number of ways. For example, if additional cooling is needed and less dehumidification is required, the regeneration temperature of the air exiting the condenser coil can be reduced by increasing the airflow across the condensing coil to one or both of the fans which move the air across that coil. Additionally, the rotary speed of the desiccant wheel may be reduced in order to lessen the dehumidification capacity and increase the cooling capacity to a maximum ratio wherein the wheel is stopped.

In another embodiment of the present invention, latent (dehumidification) work capacity of the system can be reduced under appropriate conditions by bypassing some of the supply air from the condenser coil 52 around the wheel to avoid dehumidification of some of the supply air. This can be done by appropriate duct work, vents or air valves and controls, as would be apparent to those skilled in the art.

Another embodiment of the invention is illustrated in FIGS. 10 and 11. In this embodiment, when exhaust air is available from the enclosed space, that air can be added to the supply air stream, as illustrated in FIG. 10, and provided to the cooling coil, with or without a bypass of the wheel.

In this embodiment, by providing appropriate ducting, air valves and controls, the exhaust air from the room can be used for regeneration by the desiccant wheel, as illustrated in FIG. 11, enabling the system to be switched between an active moisture processing unit (FIG. 10) and a typical ERV device (FIGS. 1, 11).

When dehumidification is needed, the system airflow is arranged as shown in FIG. 10, the refrigerant system operates, exhaust air from the room is supplied to the cooling coil and then to the desiccant wheel as described above. In this condition the wheel will spin at a slow rate of 6–20 rph and act as an active desiccant wheel. However, when conditions require no dehumidification, the refrigerant system is shut down and airflow is arranged so that the room return air flows over the condenser coil to the atmosphere and the wheel spins at a rate of 10–30 rpm taking on the characteristics of an enthalpy wheel, similar to that shown in FIG. 1. In this manner, the summer moisture and cooling load and the winter heating and humidification loads on the system are minimized as is typical of an ERV installation. However, the system in accordance with the invention has the added benefit of active dehumidification capacity when needed.

It is noted that the system of the present invention need not be designed in such a manner that all of the cooled air travels through the desiccant wheel. In environments where latent heat ratios are smaller, or when the unit is used in a recirculating mode, only part of the treated air may need to travel through the wheel, as shown in the examples of FIGS. 9 and 10. Also, the desiccant wheel may be retrofitted into a standard cooling unit, utilizing the existing fans and coils for the primary air moving device, with additional plenums, ducts or fans for directing the condenser heat through the regeneration side of the rotor.

In yet another embodiment of the present invention shown in FIG. 12, an evaporative cooler 80 may be used to selectively cool the ambient air prior to entering the condenser coil to increase the efficiency of the coil in lieu of the fan 70 used in the embodiment of FIG. 8. In this embodiment the evaporative cooler (which is of conventional construction) is operated when the regeneration temperature of air leaving the condenser exceeds the air temperature required for regeneration of the desiccant wheel or when the compressor head pressure reaches a predetermined pressure. As seen in FIG. 8 condenser water collected at the cooling coil 52 is pumped by condensate pumps 82 through a supply line 84 to the water distribution device 86 located conventionally above the corrugated layers of the evaporative cooler body 88. Water discharged from the bottom of that body to sump 90 is supplied by line 92 to the condensate sump 94.

While this system is counterintuitive since it adds moisture to the desiccant wheel air regeneration or drying air stream, it has significant advantages in the systems of the present invention, as demonstrated by the psychometric chart of FIG. 13. As seen therein atmospheric air supplied to the cooling coil passes through the temperature and humidity conditions A, B, C, and D before being supplied to the space or enclosure in the same manner as described above with respect to the embodiment of FIG. 7. On the regeneration side, however, when the temperature of air leaving the condenser coil 58 exceeds a desired level, or if the compressor head pressure exceeds a predetermined pressure as described above, pump 82 is activated to activate the evaporative cooler which lowers the temperature of cooling air entering the condenser to point E thereby improving compressor efficiency in the refrigeration system with only a slight increase in moisture content in the regeneration air stream.

Although illustrative embodiments of the present invention have been described herein with reference to the accompanying drawings, it is to be understood that the invention is not limited to those precise embodiments, but that various changes and modifications can be effected therein by those skilled in the art without departing from the scope or spirit of this invention.

What is claimed is:

1. A method for conditioning ambient air for supply to an enclosure comprising the steps of cooling an ambient supply air stream having a temperature range of between 65° F.–95° and above and a moisture content of between 90–180 gr/lb with a refrigerant system cooling coil to reduce the moisture content and temperature thereof to a first predetermined moisture content saturation level and saturation temperature range, passing the thus cooled and dried ambient supply air stream through a segment of a rotating desiccant wheel under conditions which increase its temperature to a second predetermined temperature range of about 73° F.–78° F. and reduces its moisture content further to a predetermined humidity level of between 55–71 gr/lb; and then delivering the thus treated air to said enclosure; and regenerating the desiccant wheel by heating an ambient regeneration air stream whose temperature and moisture content are substantially the same as that of the ambient supply air stream with the condensing coil of the refrigerant system to increase its temperature to a third predetermined temperature range of 105° F.–135° F. while decreasing its relative humidity and then passing the heated regeneration air stream through another segment of the rotating desiccant wheel to regenerate the desiccant in the wheel.

2. The method of claim 1, including the step of exhausting the regeneration air stream leaving the desiccant wheel to the atmosphere.

3. The method as defined in claim 1, wherein said step of cooling the supply air stream to said first predetermined temperature range comprises the step of cooling the air supply stream to a temperature range of between 45° and 68° F.

4. The method as defined in claim 3, wherein said step of cooling the supply air stream to said first predetermined temperature range comprises the step of cooling the air supply stream to a temperature of between 60° and 65° F.

5. The method as defined in claim 1, wherein said second predetermined temperature range is between 73° to 78° F. and said predetermined humidity level is between 55 and 71 gr/lb.

6. The method as defined in claim 3, wherein said second predetermined temperature range is between 73° to 78° F. and said predetermined humidity level is between 55 and 71 gr/lb.

7. The method for conditioning air as defined in claim 1, wherein said step of heating the regeneration air stream to said third predetermined temperature range comprises the step of heating the regeneration air stream to a temperature range of 105° to 135° F.

8. The method for conditioning air as defined in claim 3, wherein said step of heating the regeneration air stream to said third predetermined temperature range comprises the step of heating the regeneration air stream to a temperature range of 105° to 135° F.

9. The method for conditioning air as defined in claim 5, wherein said step of heating the regeneration air stream to said third predetermined temperature range comprises the step of heating the regeneration air stream to a temperature range of 105° to 135° F.

10. The method as defined in claim 1, wherein said step of heating the regeneration air stream to said third predetermined temperature range includes the step of selectively drawing a portion of the regeneration air stream over said condensing coil for the refrigeration system and exhausting said portion of the regeneration air stream to the atmosphere upstream of the desiccant wheel whereby only a portion of the regeneration air stream is passed through the desiccant wheel.

11. The method as defined in claim 1, wherein said step of selectively drawing a portion of the regeneration air stream over the condensing coil is performed when the condensing head pressure exceeds a predetermined pressure limit.

12. The method as defined in claim 11, wherein said predetermined pressure limit is between 250 and 350 psi.

13. The method as defined in claim 1, including selectively varying the rotational speed of the desiccant wheel to vary dehumidification capacity.

14. The method as defined in claim 1, including the step of varying dehumidification capacity by passing a portion of the supply air stream from said cooling coil around the desiccant wheel directly to the enclosure.

15. The method as defined is claim 1, including the step of selectively deactivating the refrigerant system and supplying return air to the regeneration segment of the desiccant wheel whereby the desiccant wheel selectively serves as an energy recovery ventilator.

16. The method as defined in claim 1, including the step of rotating the desiccant wheel at a rate of 6–20 rph.

17. The method as defined in claim 15, including the step of rotating the desiccant wheel at a rate of 10–30 rpm when the refrigerant system is deactivated.

18. The method as defined in claim 1, including the step of drawing a first portion of the regeneration air stream over said condensing coil and exhausting it to the atmosphere upstream of the desiccant wheel whereby only a second portion of the regeneration air stream is passed through the desiccant wheel.

19. The method as defined in claim 18, wherein said condensing coil includes a first section for heating regeneration air and a second section for increasing cooling of the coil; and said step of drawing a first portion of the regeneration air stream over said condensing coil comprises the step of drawing said first portion only over the second section of the condensing coil.

20. The method as defined in claim 18, drawing a first portion of the regeneration air stream over the second section of the condensing coil is performed when the condensing head pressure in the condensing coil exceeds a predetermined pressure limit.

21. The method as defined in claim 19, wherein said predetermined pressure limit is between 250 and 35 psi.

22. An apparatus as defined in claim 1, wherein said desiccant wheel includes means for preventing odors from being released in the enclosure.

23. The method as defined in claim 10 wherein the step of selectively drawing a portion of the regeneration air stream over said condensing coil is performed to control a predetermined head pressure of refrigerant temperature in the refrigerant system.

24. The method as defined in claim 10 wherein said step of selectively drawing a portion of the regeneration air stream over the condensing coil includes the step of varying the volume of said portion of the regeneration air stream to maintain a predetermined head pressure or condenser leaving air temperature.

25. The method as defined in claim 1 including the step of precooling the regeneration air stream before passing it over the condenser coil when the temperature of air leaving the condenser coil is above a predetermined temperature or when the compressor head pressure in the refrigerant system is above a predetermined pressure.

* * * * *